US008640349B2

(12) United States Patent
Wasilewski et al.

(10) Patent No.: US 8,640,349 B2
(45) Date of Patent: Feb. 4, 2014

(54) DUAL BAR ADJUSTABLE BOW SIGHT

(75) Inventors: Don Wasilewski, Stansbury Park, UT (US); Zak T. Kurtzhals, Herriman, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 207 days.

(21) Appl. No.: 13/209,216

(22) Filed: Aug. 12, 2011

(65) Prior Publication Data

US 2013/0036617 A1 Feb. 14, 2013

(51) Int. Cl.
*F41G 1/467* (2006.01)

(52) U.S. Cl.
USPC ..... 33/265; 124/87

(58) Field of Classification Search
USPC ..... 33/265; 124/87
See application file for complete search history.

(56) References Cited

U.S. PATENT DOCUMENTS

| | | | | | |
|---|---|---|---|---|---|
| 3,320,670 | A * | 5/1967 | Ambraziatis | 33/265 |
| 4,178,693 | A * | 12/1979 | Smith | 33/265 |
| 5,001,837 | A * | 3/1991 | Bray | 33/265 |
| 5,495,675 | A * | 3/1996 | Huang | 42/115 |
| 5,507,272 | A * | 4/1996 | Scantlen | 124/87 |
| 5,632,091 | A * | 5/1997 | Brion et al. | 33/265 |
| 5,657,740 | A * | 8/1997 | Slates et al. | 124/87 |
| 6,000,141 | A * | 12/1999 | Afshari | 33/265 |
| 6,073,352 | A * | 6/2000 | Zykan et al. | 33/265 |
| 6,098,608 | A * | 8/2000 | Oshlick | 124/87 |
| 6,418,633 | B1 * | 7/2002 | Rager | 33/265 |
| 6,609,306 | B2 * | 8/2003 | Johnson et al. | 33/265 |
| 6,634,110 | B2 * | 10/2003 | Johnson | 33/265 |
| 6,802,129 | B1 * | 10/2004 | Wirth | 33/265 |
| 6,851,197 | B2 * | 2/2005 | Terry et al. | 33/265 |
| 6,925,721 | B2 * | 8/2005 | Dietz | 33/265 |
| 7,832,109 | B2 * | 11/2010 | Gibbs et al. | 33/265 |
| 7,900,365 | B1 * | 3/2011 | Johnson | 33/265 |
| 2002/0148125 | A1 * | 10/2002 | Shepherd | 33/265 |
| 2005/0150119 | A1 * | 7/2005 | Ellig et al. | 33/265 |
| 2006/0201005 | A1 * | 9/2006 | Lueck | 33/265 |
| 2008/0289201 | A1 * | 11/2008 | Kroening, Jr. | 33/265 |
| 2011/0271944 | A1 * | 11/2011 | Haney et al. | 124/87 |

* cited by examiner

*Primary Examiner* — Christopher Fulton
(74) *Attorney, Agent, or Firm* — Holland & Hart

(57) ABSTRACT

A bow sight includes a mounting assembly, a sight component, and an adjustment system. The bow sight is mounted to an archery bow with the mounting assembly. The adjustment system couples the sight component to the mounting assembly. The mounting assembly includes at least one support rail and a mounting bracket. The mounting bracket connects to the archery bow and is infinitely adjustable along a length of the at least one support rail to adjust a position of the sight component toward and away from the archery bow.

13 Claims, 12 Drawing Sheets

DUAL BAR ADJUSTABLE BOW SIGHT

BACKGROUND

Bow sights are devices that are coupled to an archery bow to help the archer aim the bow at a target a given distance from the archer. Although some archers shoot a bow without a bow sight (known as "instinctive shooting"), it can be difficult to do so accurately—especially at longer ranges. Because of this, most conventional bows, particularly compound bows, are outfitted with some kind of bow sight. A bow sight greatly enhances accuracy at a known distance, especially if used with a peep sight or kisser-button.

The trajectory of an arrow changes significantly as a function of horizontal distance. In order to compensate for arrow drop over distance, many bow sights include multiple sight pins that are adjusted to correspond to certain horizontal distances. Each sight pin typically includes sight indicia such as a fiber optic point, which makes it easy for the archer to see, especially in low light conditions. The sight indicia of the multiple sight points are most often aligned along a single, vertical axis or line, one above or below another. Depending on the horizontal distance to the target, the user must select a sight pin corresponding to the vertical distance to the target, and then align the sight indicia with the target. If the user's range estimation, pin selection, and indicia alignment are correct, then the arrow, assuming it was launched properly, should hit the target.

Bow sights are usually adjustable in one form or another to allow the archer to "sight in" the bow sight. Bow sights are also often mounted to the bow at multiple fixed locations either along the bow itself (e.g., across a width or along a length of the riser of the bow) or at different locations along a mounting component of the bow sight. Adjusting a position of the entire bow sight relative to the bow may assist with aligning sight components of the bow sight with a peep sight that is mounted to a bowstring of the bow or other sight features. A bow sight mounting that has only a few predetermined, incremental adjustment positions for the bow site relative to the bow is inadequate. Accordingly, it would be desirable to provide an improved bow sight and particularly a bow sight mounting feature that has improved adjustability.

SUMMARY

One aspect of the present disclosure relates to a bow sight that includes a mounting assembly, a sight component, and an adjustment system. The mounting assembly is configured to mount the bow sight to an archery bow. The adjustment system is configured to couple the sight component to the mounting assembly. The mounting assembly includes at least one support rail and a mounting bracket. The mounting bracket is configured to connect to the archery bow and is infinitely adjustable along a length of the at least one support rail to adjust a position of the sight component toward and away from the archery bow.

The mounting assembly may include first and second support rails, and the mounting bracket is mounted to and movable along the first and second support rails. The first and second support rails may be arranged side-by-side and parallel with each other. The mounting bracket may include first and second bracket portions positioned on opposing sides of the at least one support rail. The mounting bracket may include a plurality of fasteners configured to connect the first and second bracket portions together and to the at least one support rail. The plurality of fasteners may be configured to connect the mounting assembly to the archery bow. The first and second support rails may be arranged in a common vertical plane.

Another aspect of the present disclosure relates to an archery bow that includes a riser, a pair of limbs extending from the riser, a bowstring extending between the limbs, a peep sight, and a bow sight. The peep sight is mounted to the bowstring and includes a peep window having a peep window perimeter. The bow sight is adjustably mounted to the riser with a mounting assembly and includes a bow sight window having a bow sight window perimeter. The mounting assembly may be operable to move the bow sight window toward and away from the peep sight to align the peep window perimeter with the bow sight window perimeter when looking through the peep window.

The mounting assembly may be infinitely adjustable. The mounting assembly may include a mounting bracket and at least one support rail. The mounting assembly may be mounted to the riser and movable along the at least one support rail to move the bow sight window toward and away from the peep sight. The at least one support rail may include first and second support rails. The peep window perimeter and bow sight window perimeter may each have a circular shape.

A further aspect of the present disclosure relates to a method of operating an archery bow. The method may include providing an archery bow that includes a riser, a bowstring, a peep sight mounted to the bowstring, and a bow sight mounted to the riser. The peep sight may have a peep window with a peep window perimeter, and the bow sight may have a bow sight window with a bow sight window perimeter. The method may also include adjusting the bow sight to move the bow sight window toward and away from the peep window until the bow sight window perimeter is aligned with the peep window perimeter when looking through the peep window.

The method may include providing infinite adjustability of the bow sight when moving the bow sight window toward and away from the peep window. The method may include drawing the bow and maintaining the bow in a drawn position while adjusting the bow sight. The bow sight may include a mounting assembly and a sight component, wherein the sight component defines the bow sight window and the mounting assembly includes a mounting bracket configured to connect the bow sight to the riser, and first and second support rails coupled to the mounting bracket and the sight component. Adjusting the bow sight includes moving the mounting bracket along the first and second support rails. Adjusting the bow sight may include sliding a mounting bracket of the bow sight along at least one support rail of the bow sight, wherein the bow sight window is coupled to the at least one support rail.

Another example method relates to a method of operating a bow sight assembly. The method includes providing a bow sight mounted to a riser of an archery bow, and a peep sight mounted to a bowstring of the archery bow, wherein the peep sight includes a peep window. The method also includes providing sliding adjustment of the bow sight relative to the peep sight to align portions of the bow sight within the peep window when looking through the peep window.

The peep window may include a peep window perimeter, and the bow sight may include a bow sight window with a bow sight window perimeter. Aligning portions of the bow sight within the peep window may include aligning the bow sight window perimeter with the peep window perimeter. The sliding adjustment may include moving a sight component of the bow sight toward and away from the peep sight. The sliding adjustment may include infinite sliding adjustment of the bow sight relative to the peep sight.

The foregoing and other features, utilities, and advantages of the subject matter described herein will be apparent from the following more particular description of certain embodiments as illustrated in the accompanying drawings.

DRAWINGS

DETAILED DESCRIPTION

Figure 1:
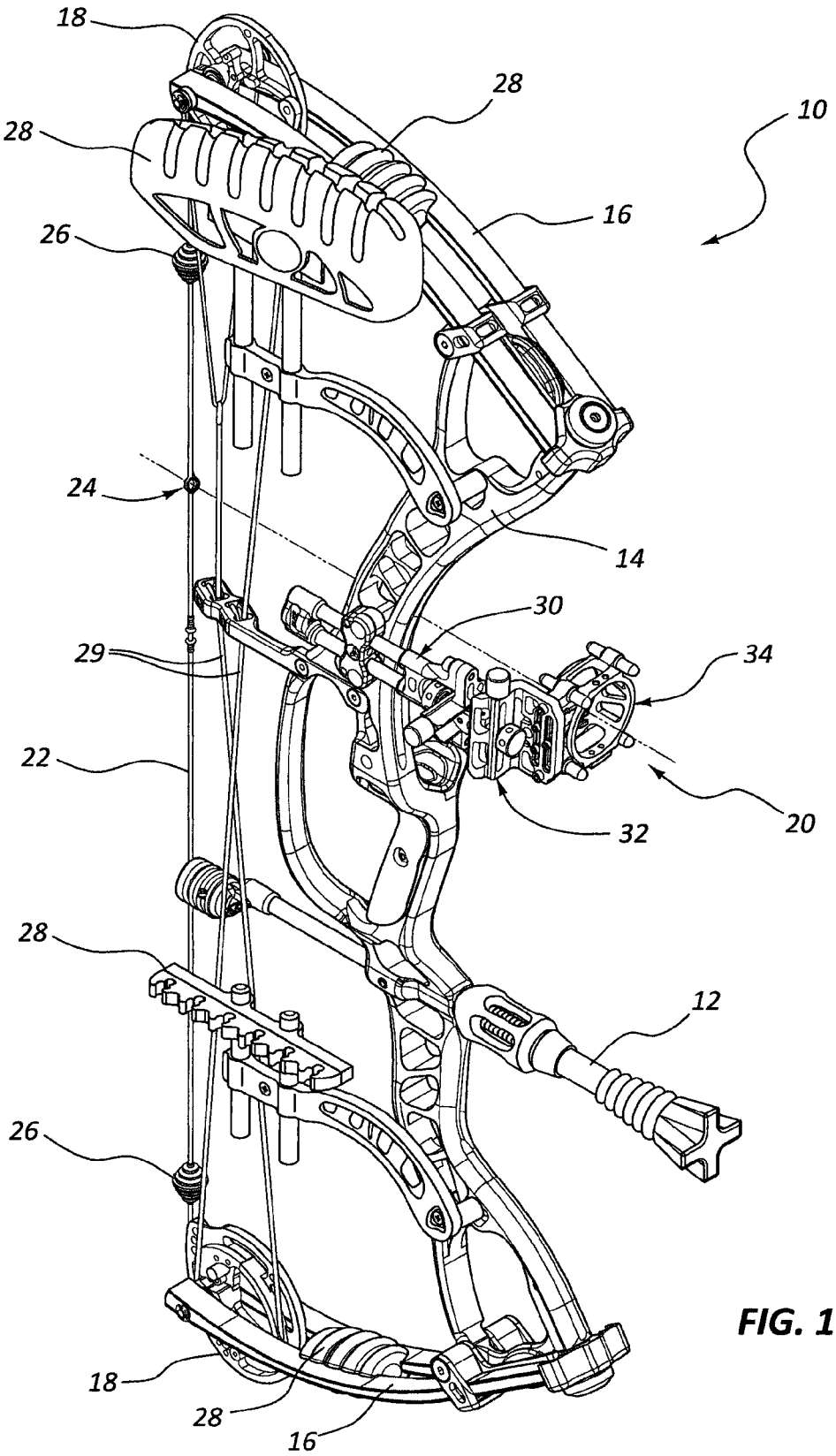
FIG. 1 shows a perspective view of a bow and a bow sight in a first adjusted position relative to the bow in accordance with the present disclosure.

The present disclosure relates to archery bows, and more particularly relates to bow sights for archery bows. Another aspect of the present disclosure relates to adjusting a bow sight relative to a frame (e.g., the riser portion) of the archery bow. Adjustability of the bow sight may help align features of the bow sight such as a sight component with features of a peep sight that is mounted to the bowstring of the bow. In one example, the peep sight includes a peep window having a peep window periphery, the bow sight includes a bow sight window having a bow sight window periphery, and the bow sight is adjustable to align the bow sight window periphery with the peep window periphery when looking through the peep window. The bow sight may be infinitely adjustable along a length dimension of the bow sight to align features of the sight component of the bow sight with features of the peep sight. The bow sight may provide a sliding adjustment of portions of the bow sight relative to the bow frame (e.g., riser of the archery bow). The entire bow sight may be slidingly adjustable relative to the bow frame.

In one example, the bow sight includes a pair of sliding rails to which a mounting bracket is slidingly connected. The mounting bracket is used to connect the bow sight to the frame of the bow and also provide a sliding connection with the rails of the bow sight to provide infinite adjustability of the sight components relative to the archery bow (e.g., riser, bowstring, and peep sight mounted to the bowstring). Using at least two rails for the sliding connection of the bow sight may provide additional stability for the bow sight during adjustment. The use of multiple rails may help maintain the sight components of the bow sight in a given orientation (e.g., aligned with the longitudinal axis of the archery bow) before, during, and after sliding adjustment of the bow sight.

The rails and mounting bracket of the bow sight may be part of a mounting assembly of the bow sight. The bow sight may also include an adjustment system interposed between the mounting assembly and the sight component. The adjustment system may provide fine tune adjustment of the sight component when "sighting in" the bow sight. The adjustability of the mounting assembly may be used to adjust the sight component relative to the peep sight or other features of the bow.

The mounting assembly may provide infinite adjustability of the bow sight. The infinite adjustability may relate to a length adjustment of the mounting bracket along the length of at least one rail of the bow sight to adjust a position of sight components toward and away from other features of the archery bow such as, for example, a peep sight mounted to the bowstring. Infinite adjustability may be defined at least in part as unconstrained and non-incremental adjustment in at least one direction, wherein there are no predetermined or preset adjusted positions in that direction or at least within a certain distance in that direction. An adjusted position of the mounting bracket relative to the at least one rail resulting from the infinite adjustability may be fixed or locked into place using, for example, features of the mounting bracket.

Figure 2:
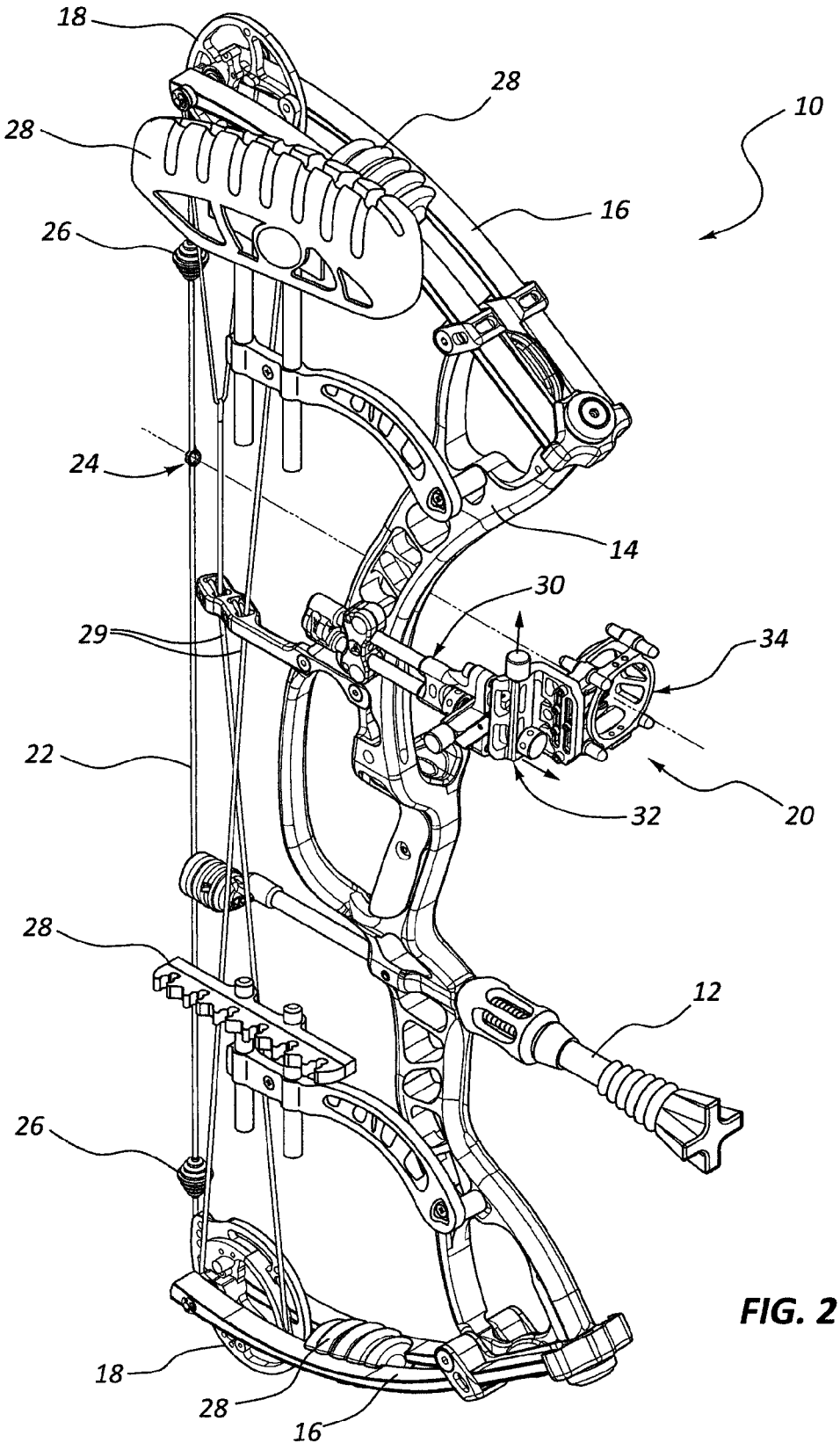
FIG. 2 shows another perspective view of the bow and bow sight of FIG. 1 with the bow sight in a second adjusted position relative to the bow.
Figure 3:
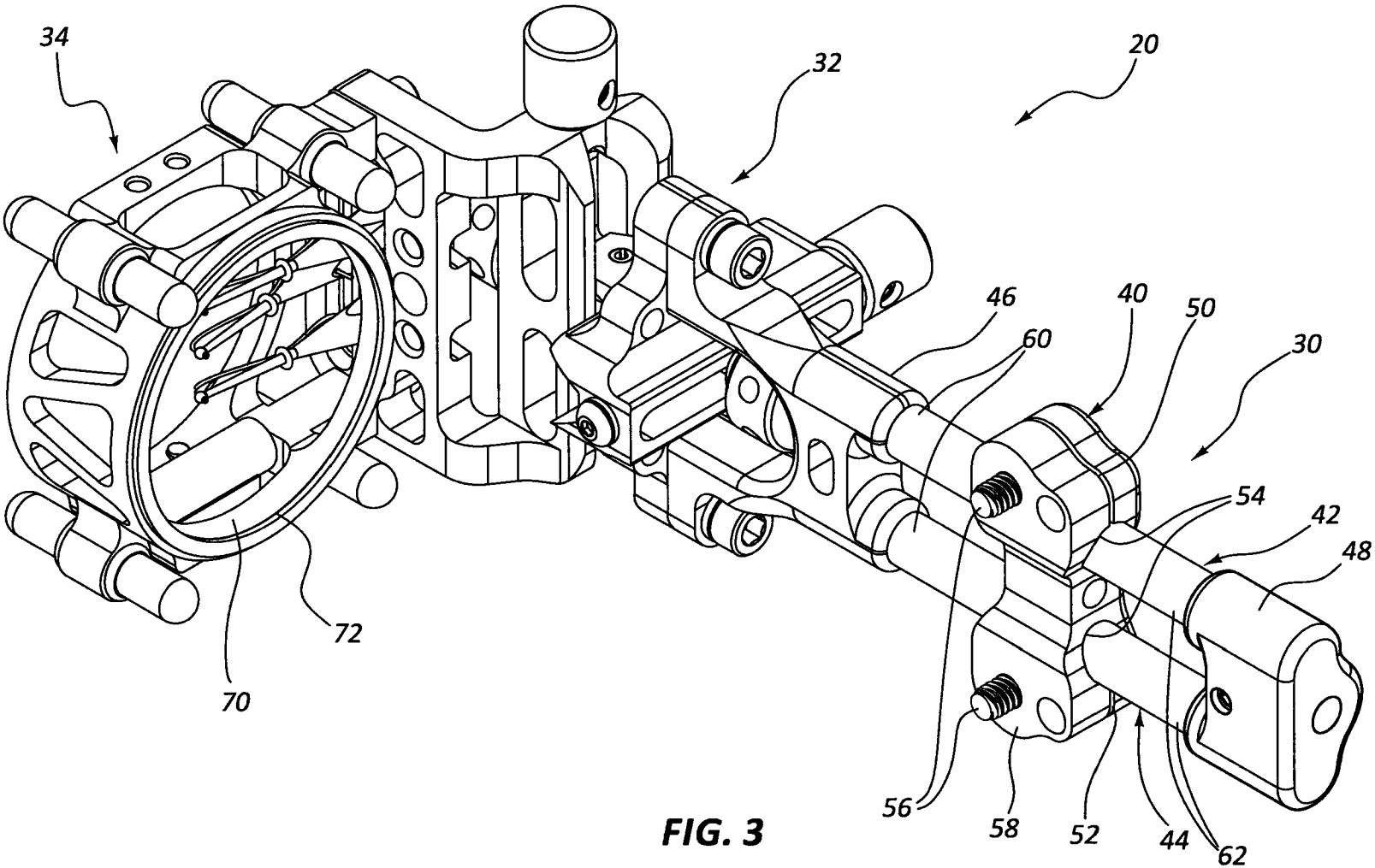
FIG. 3 shows a perspective view of the bow sight of FIG. 1.
Figure 4:
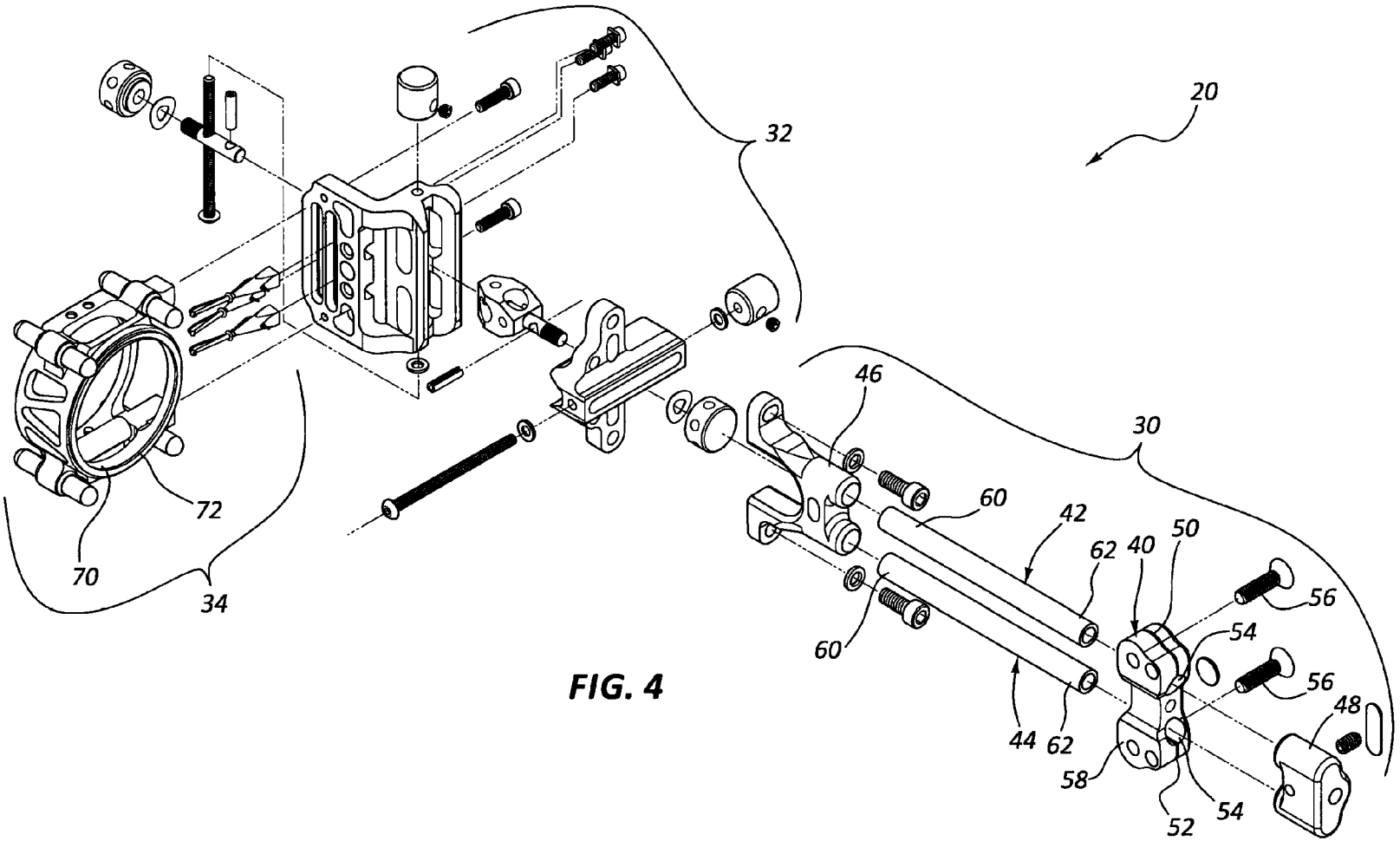
FIG. 4 shows a exploded perspective view of the bow sight of FIG. 1.

Referring to FIGS. 1 and 2, an archery bow 10 is shown including a stabilizer 12, a riser 14, limbs 16, cams 18, a bow sight 20, a bowstring 22, a peep sight 24, and a plurality of cables 29. The bow sight 20 is mounted to the riser 14. The peep sight 24 may be mounted to the bowstring 22. The peep sight 24 is aligned horizontally with the bow sight 20 when the bow 10 is in a fully drawn position (see FIGS. 10-12). The bow 10 may also include bowstring dampeners 26 and various other vibration dampeners 28 to reduce the amount of noise generated when the bow 10 is released.

Those skilled in the art will appreciate that the bow sight 20 may be used with any suitable bow. The bow 10 is shown as one example of a type of bow that is suitable to be used with the bow sight 20. Other bows that may use the bow sight 20 include other compound bows, recurve bows, long bows, and the like.

Turning now to FIGS. 3-9, the bow sight 20 includes a mounting assembly 30 (also referred to herein as a mounting portion, mounting body, or mounting component), an adjustment system or adjustment assembly 32, and a sight component 34 (also referred to herein as a sight portion, sight body, or sight end). The mounting assembly 30 is the portion of the bow sight 20 that is coupled to the riser 14 of the bow 10. A set of mounting apertures (not shown) on the riser 14 may be used to mount the mounting assembly 30 to the bow sight 20. The adjustment system 32 is configured to adjust the position of the sight component 34 relative to the mounting assembly 30. The sight component 34 includes that portion of the bow sight that is adjustable relative to the mounting assembly 30. The sight component 34 is also the portion of the bow sight 20 that is used to aim the bow.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The mounting assembly 30 includes a mounting bracket 40, first and second support rails 42, 44 (also referred to herein as first and second support bars), an adjustment support 46, and a proximal support 48. The adjustment system 32 of the bow sight 20 may be connected to the mounting assembly 30 at the adjustment support 46. The bow sight 20 may be connected to the riser 14 of the bow 10 using the mounting bracket 40. Once the mounting bracket 40 is connected to the riser 14, sliding engagement between the mounting bracket 40 and the first and second support rails 42, 44 provide adjustment of the sight component 34 relative to other features of the bow 10 such as, for example, the riser 14 and peep sight 24. The mounting bracket 40 may be configured to mount to a side surface of the riser 14, to a front or rear facing surface of the riser 14, or a combination of a side surface and at least one of the front and rear facing surface of the riser 14.

The mounting bracket 40 includes first and second bracket slits 50, 52, a plurality of rail through holes 54, a plurality of fasteners 56, and a riser contact surface 58. The rail through holes 54 are sized and configured to receive and providing sliding engagement with the first and second support rails 42, 44. The fasteners 56 are operable to close the first and second bracket slits 50, 52 to tighten the mounting bracket 40 about the first and second support rails 42, 44 thereby fixing an adjusted position of the mounting bracket 40 relative to the first and second support rails 42, 44.

The fasteners 56 may also be used to connect the mounting bracket 40 to the riser 14. In one example, the fasteners 56 include a plurality of external threads that mate with threaded features of mounting apertures (not shown) of the riser 14. In other arrangements, separate fasteners may be used to tighten the mounting bracket 40 relative to the first and second support rails 42, 44.

The fasteners 56 may also be used to connect the mounting bracket 40 to the riser 14. In one example, the fasteners 56 include a plurality of external threads that mate with the threaded features of mounting apertures (not shown) of the riser 14. In other arrangements, separate fasteners may be used to tighten the mounting bracket 40 relative to the first and second support rails 42, 44, and other fasteners may be used to connect the mounting bracket 40 to the riser 14. The use of a single set of fasteners 56 to both tighten the mounting bracket 40 about the first and second support rails 42, 44 and connect the mounting bracket 40 (and the entire bow sight 20) to the riser 14 may provide certain advantages. For example, using a single set of fasteners to perform both position adjustment and mounting functions may help reduce the number of parts and thereby reduce the cost and complexity of the bow sight 20. In alternative arrangements, a bracket feature is used to connect the bow sight 20 to the riser 14, and a separate bracket feature is used to provide a connection with the first and second support rails 42, 44.

Figure 5:
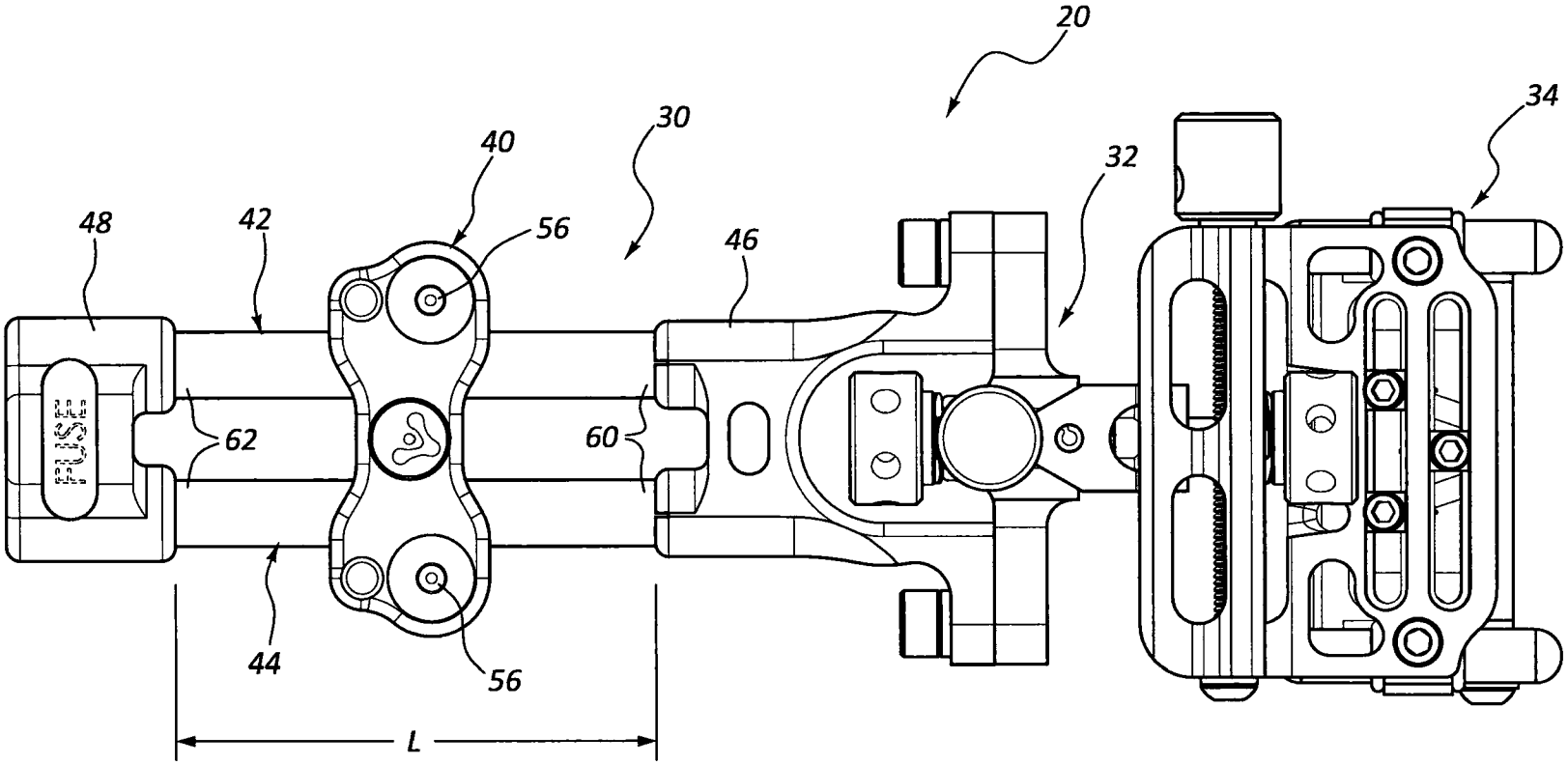
FIG. 5 shows a right side view of the bow sight of FIG. 1.
Figure 6:
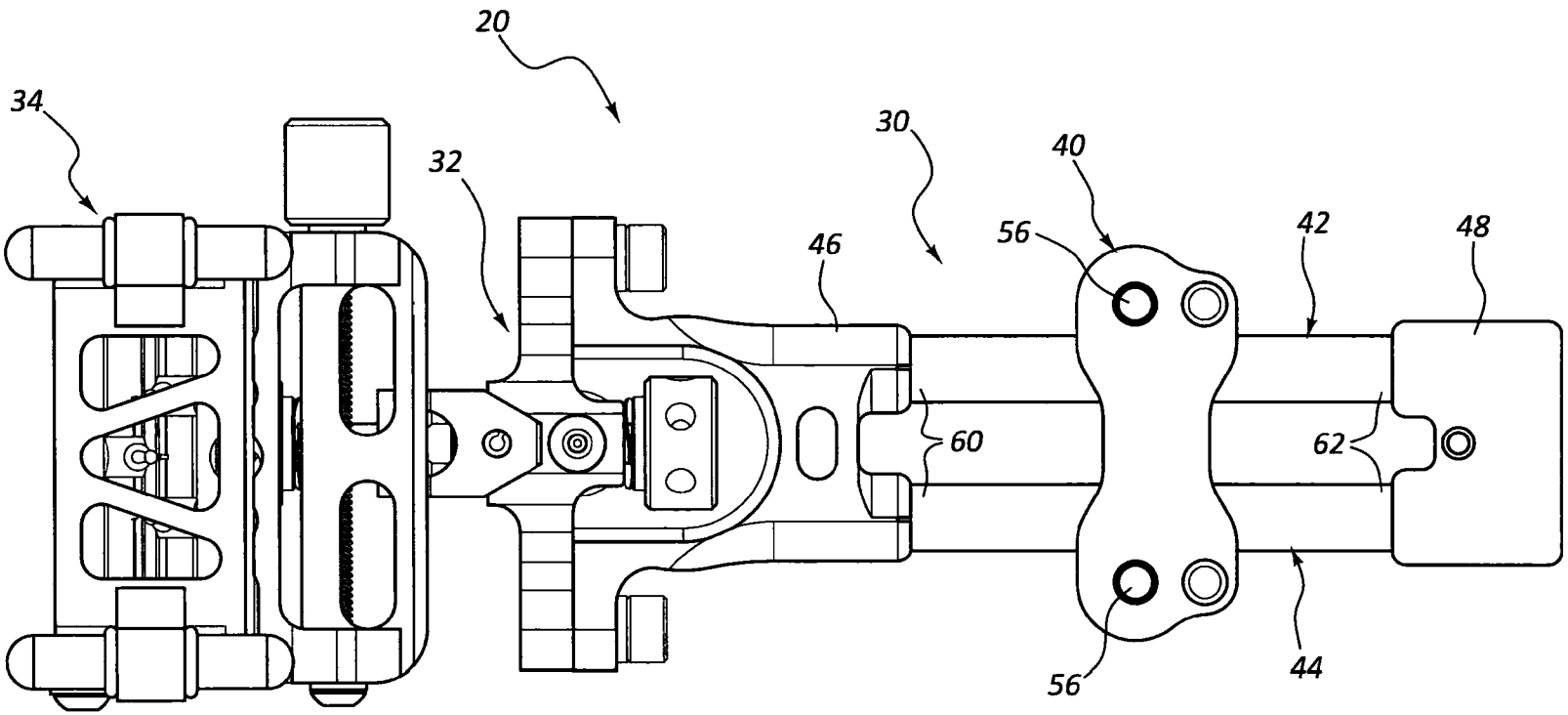
FIG. 6 shows a left side view of the bow sight of FIG. 1.
Figure 7:
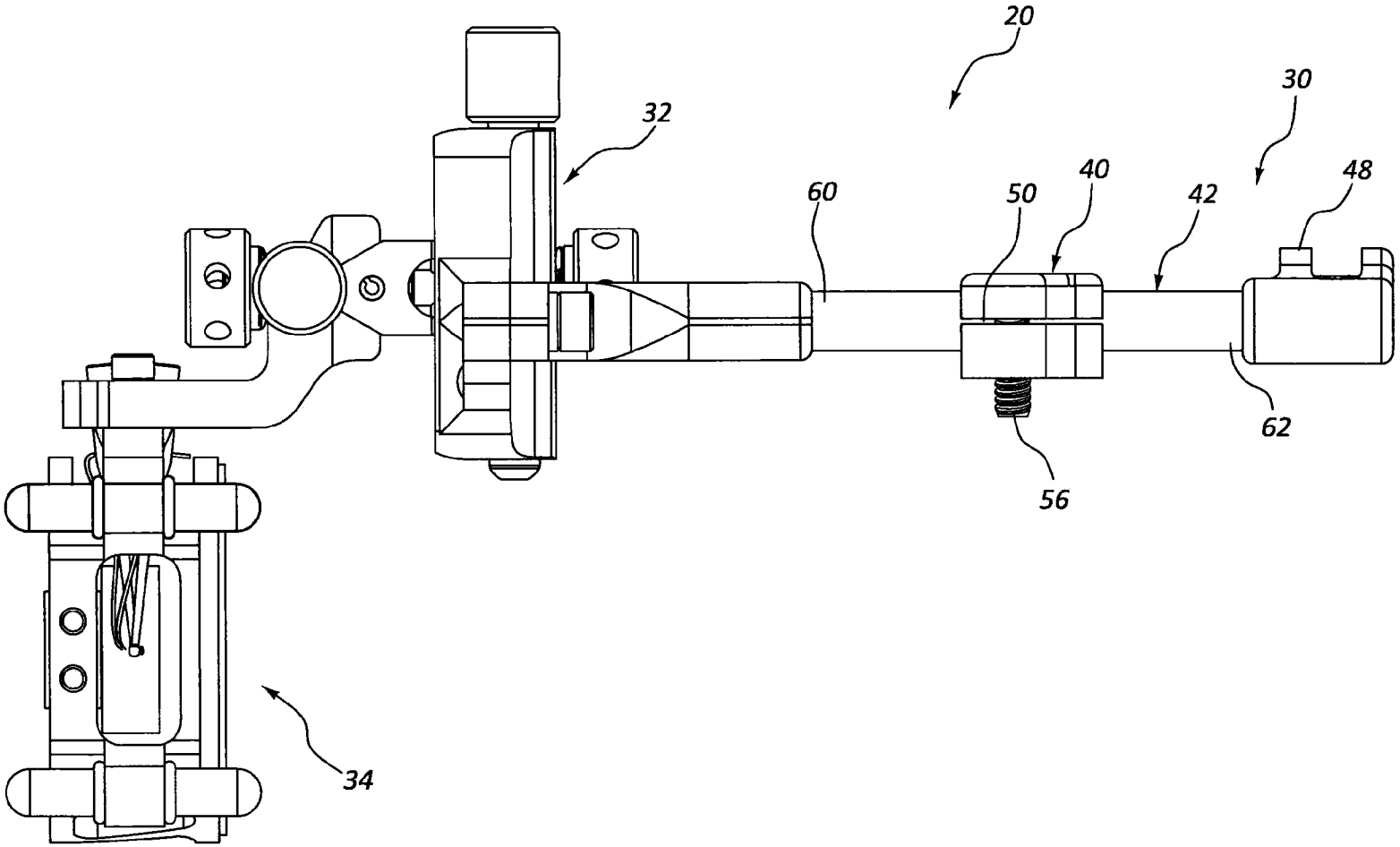
FIG. 7 shows a top view of the bow sight of FIG. 1.
Figure 8:
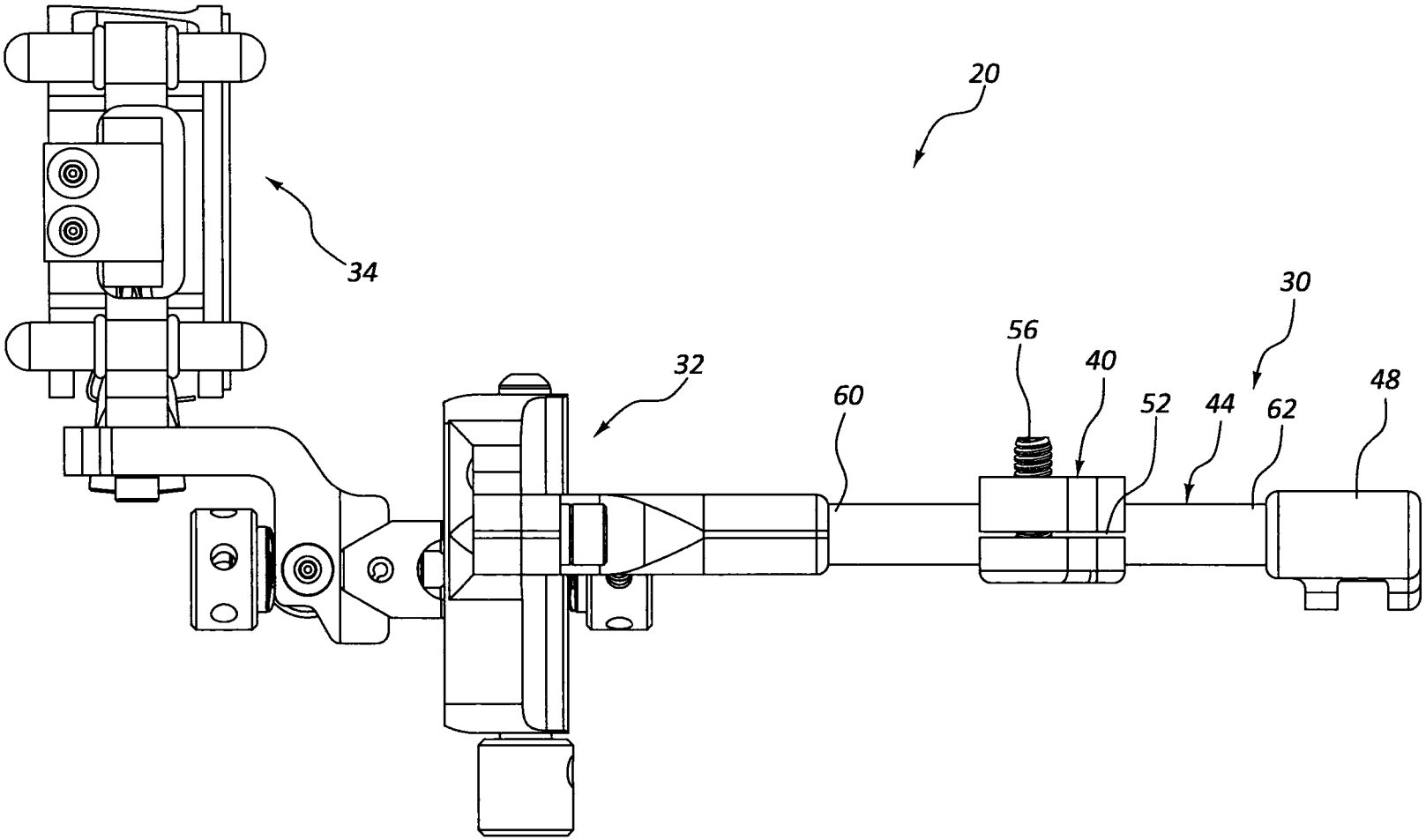
FIG. 8 shows a bottom view of the bow sight of FIG. 1.
Figure 9A:
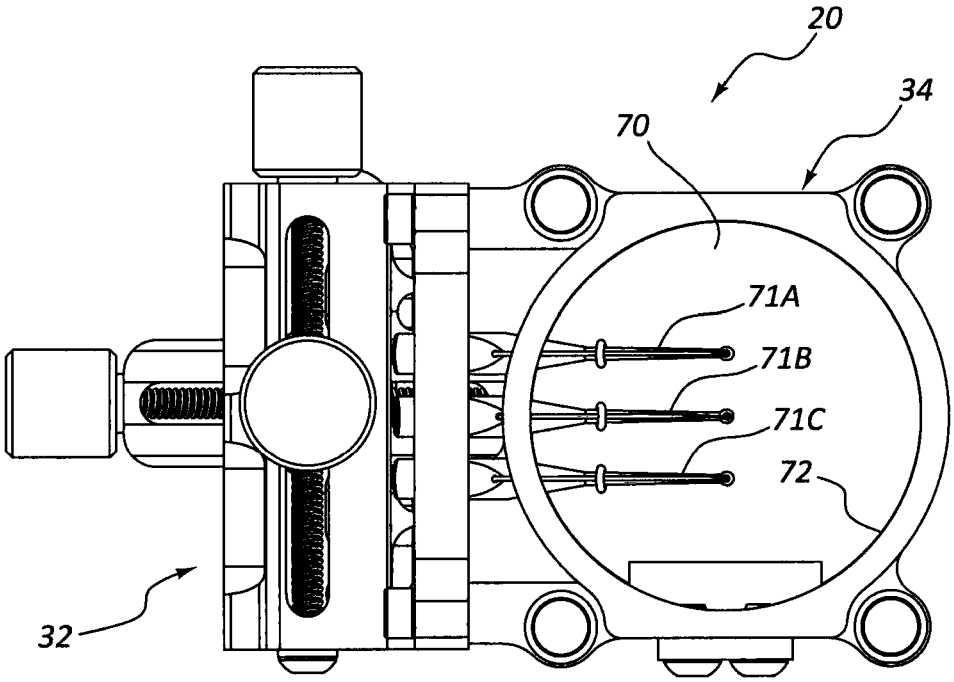
FIGS. 9A and 9B show front and rear views, respectively, of the bow sight of FIG. 1.
Figure 9B:
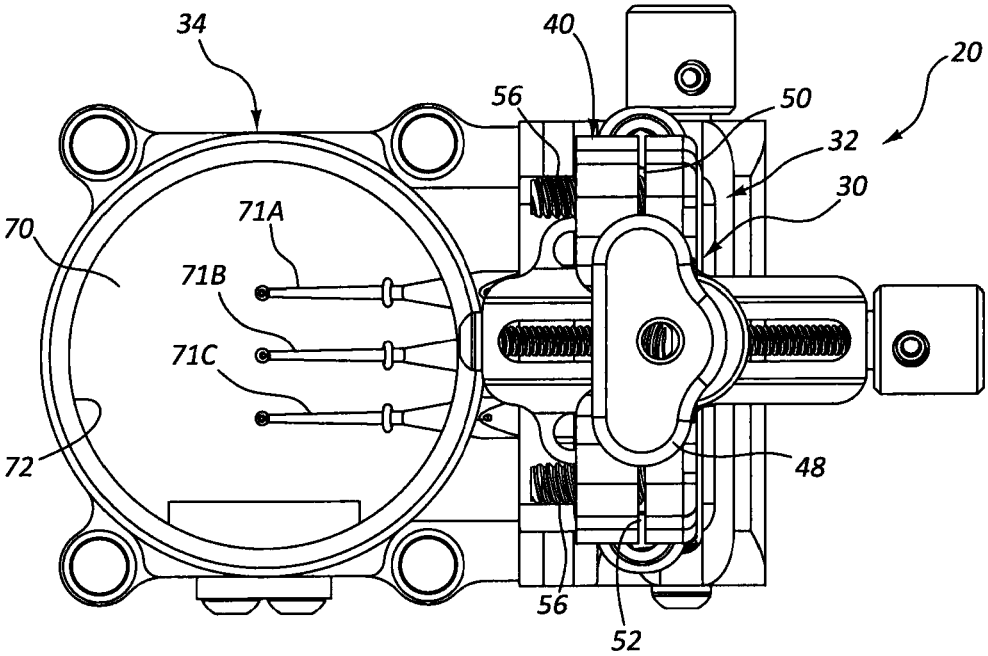

The first and second support rails 42, 44 each include distal and proximal ends 60, 62, respectively, and have a length L (see FIG. 5). The adjustment support 46 is positioned at the distal end 60. The proximal support 48 is connected at the proximal end 62. The adjustment support 46 and proximal support 48 connect the first and second support rails 42, 44 together and hold the first and second support rails 42, 44 in a fixed position relative to each other. The first and second support rails 42, 44 may be arranged side-by-side in a parallel arrangement. The first and second support rails 42, 44 may be arranged vertically relative to each other (see FIG. 5). The first and second support rails 42, 44 may be positioned within a common vertically oriented plane. Other arrangements are possible for the first and second support rails 42, 44 such as, for example, being arranged in a common horizontal plane.

The first and second support rails 42, 44 may have a similar size and shape (e.g., a circular cross-sectional shape of common diameter). Providing the first and second support rails 42, 44 with the same shape and size may make it possible to interchange the first and second support rails 42, 44 in the different rail through holes 54 of the mounting bracket 40. Other arrangements may include first and second support rails 42, 44 having at least one of a different shape and a different size (e.g., different diameter or cross-sectional shape). Providing the first and second support rails 42, 44 with different shapes, sizes or physical characteristics (e.g., material properties) may enhance desired adjustment features such as, for example, helping retain a certain adjusted position or increasing the ease of sliding the mounting bracket 40 along the length of the first and second support rails 42, 44.

Other arrangements for the mounting assembly 30 may include providing a single support rail, or providing three or more support rails. A mounting assembly 30 with a certain number of support rails may provide advantages related to, for example, increasing or reducing friction in the sliding interface between the mounting bracket 40 and first and second support rails 42, 44, or providing stability and/or alignment for the sight component 34 supported by the mounting assembly 30 and adjustment system 32.

The mounting bracket 40 may be adjustable prior to, during, or after drawing the bow 10 and/or releasing the bowstring 22 to launch an arrow. Typically, operation of the bow 10 includes drawing the bow and looking through the peep sight 24 to align the features of the bow sight 20 (i.e., a sight pin of the sight component 34) relative to a peep window 74 of the peep sight 24. When proper alignment is achieved, the operator releases the bowstring 22 to launch the arrow. Typically, properly aligning features of the peep sight 24 with features of the sight component 34 improves accuracy in shooting the arrow.

The peep sight 24 may include a peep window 74 having a peep window perimeter 76. In at least one example, the peep window perimeter 76 has a circular shape with a circumference (see FIGS. 10-12). The sight component 34 may include a bow sight window 70 having a bow sight window perimeter 72 (see FIGS. 9-12). In one example, the bow sight window perimeter 72 may have a circular shape with a circumferential perimeter.

Figure 10A:
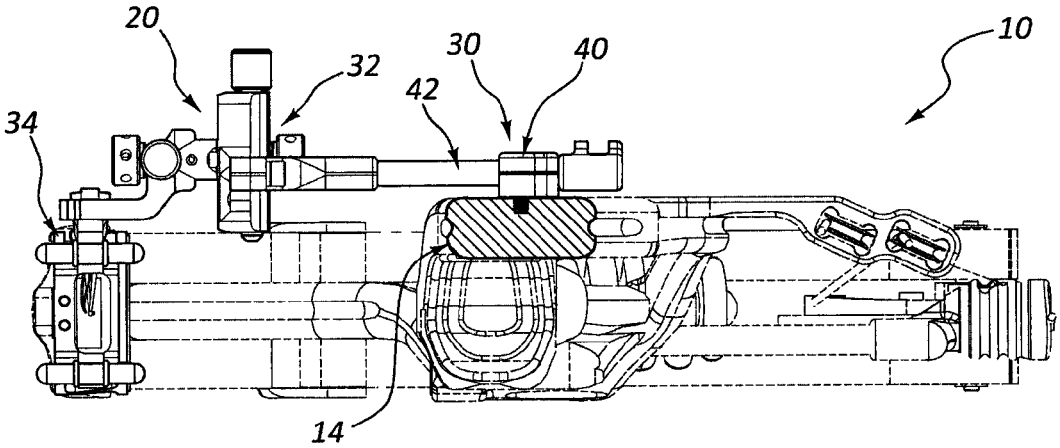
FIG. 10A shows a partial cross-sectional top view of the bow of FIG. 10B.
Figure 10B:
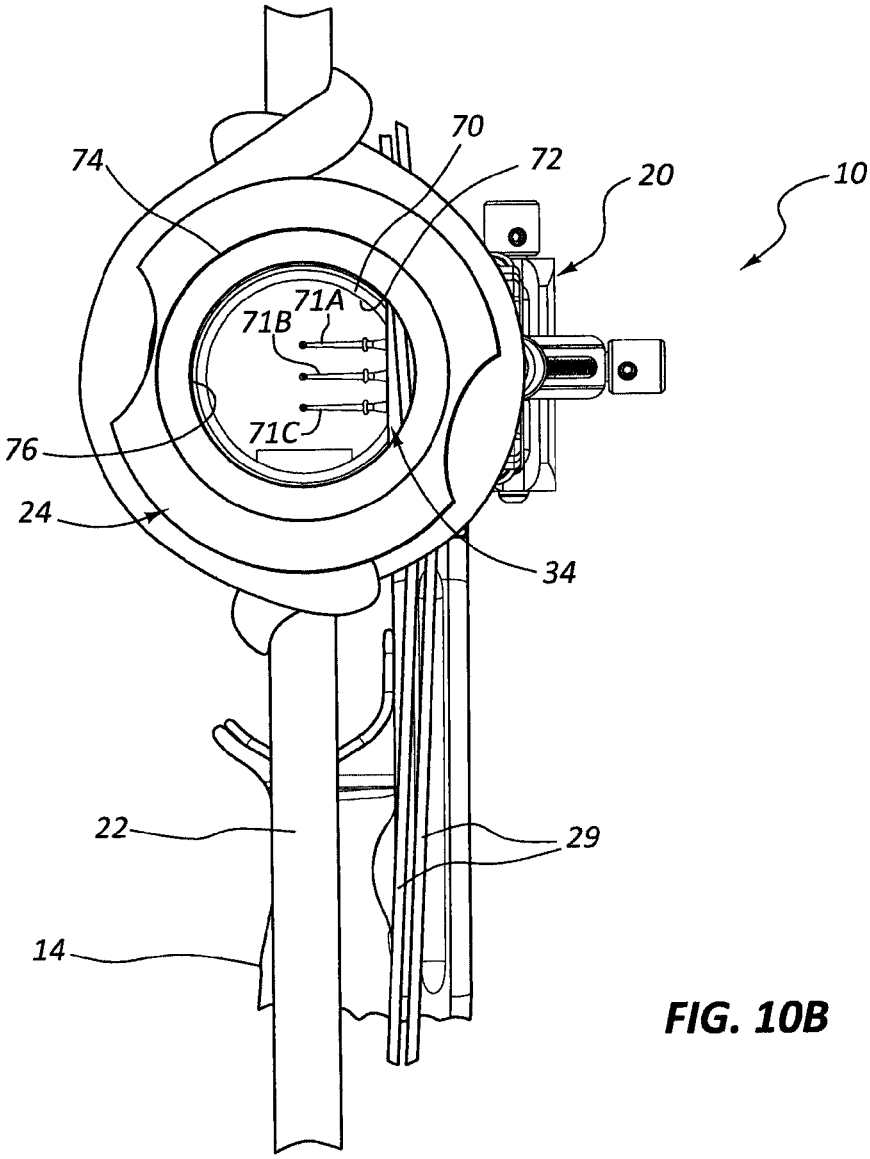
FIG. 10B shows a rear view of the bow of FIG. 1 with the bow sight in a forward adjusted position.
Figure 11A:
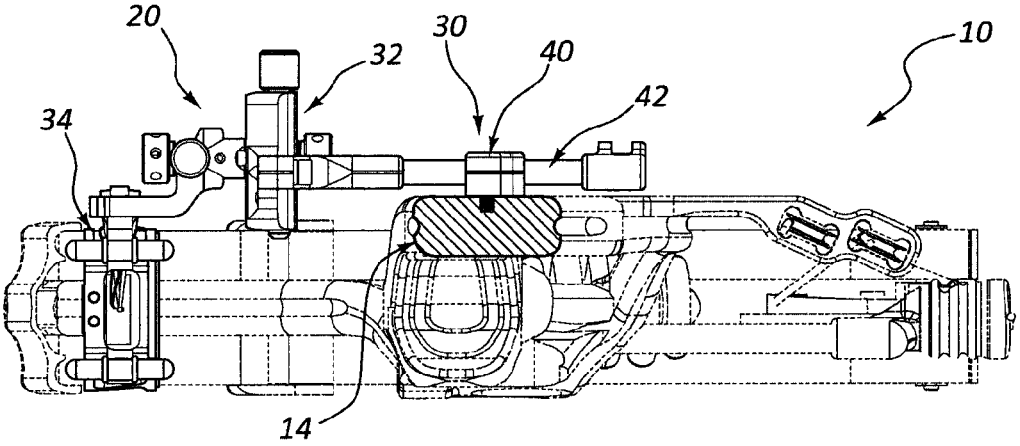
FIG. 11A shows a partial cross-sectional top view of the bow of FIG. 11B.
Figure 11B:
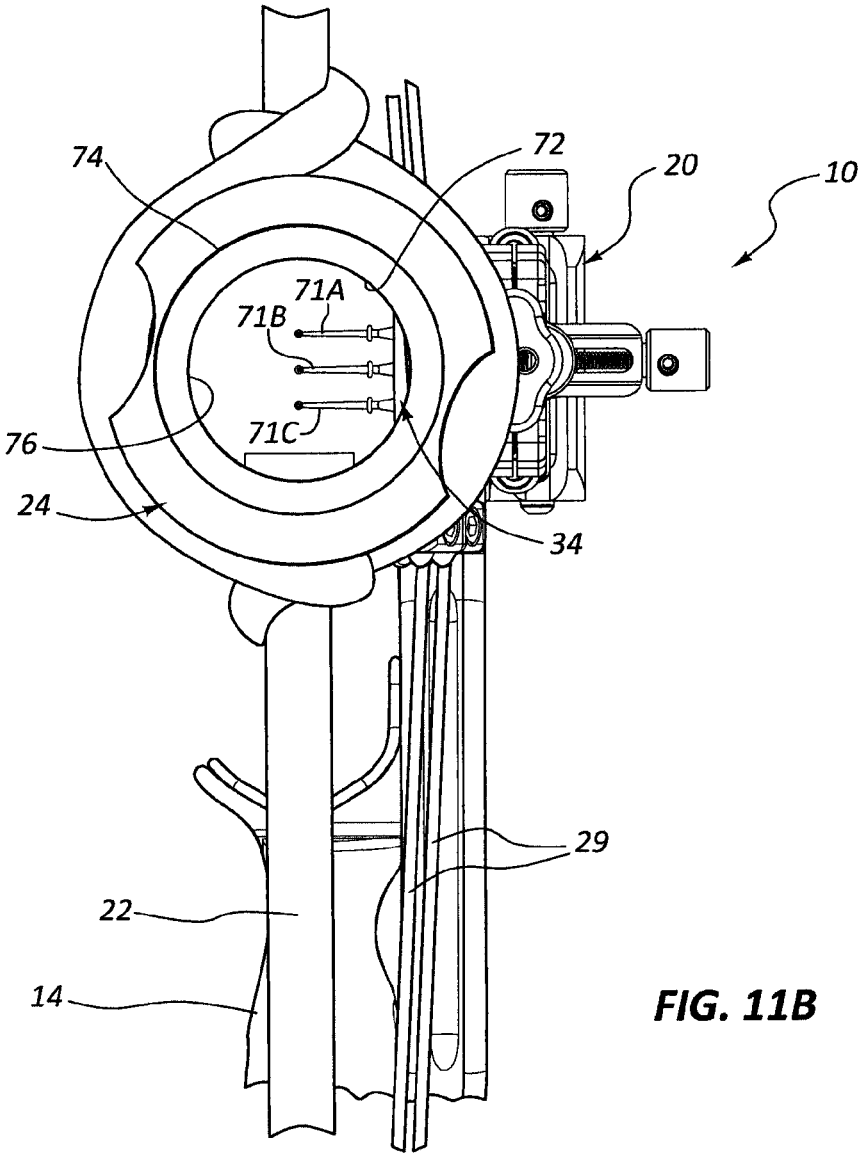
FIG. 11B shows a rear view of the bow of FIG. 1 with the bow sight in an aligned position.
Figure 12A:
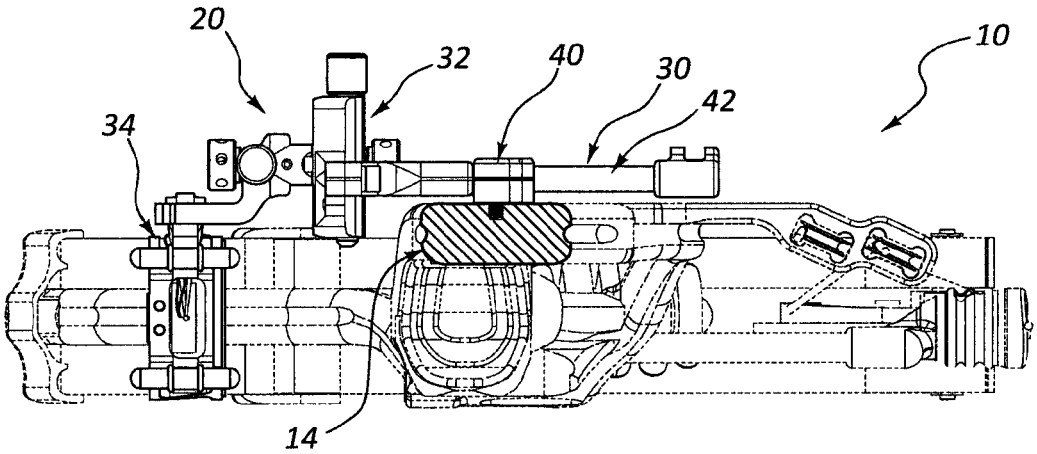
FIG. 12A shows a partial cross-sectional top view of the bow of FIG. 12B.
Figure 12B:
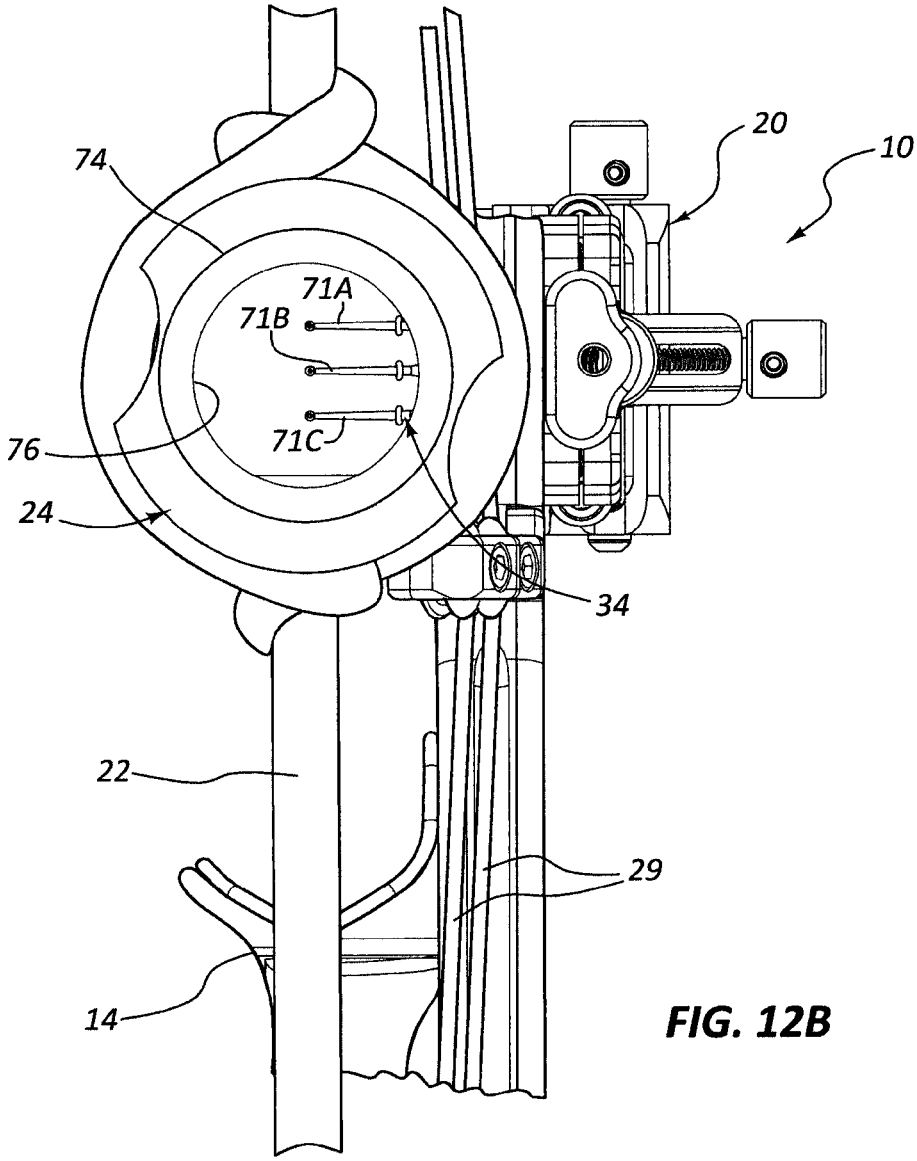
FIG. 12B shows a rear view of the bow of FIG. 1 with the bow sight in a rearward adjusted position.

The sight components 34 are most effective during operation of the bow 10 when the bow sight window perimeter 72 is aligned with the peep window perimeter 76 when looking through the peep sight 24 (e.g., with the bowstring 22 drawn). The peep window perimeter 76 is aligned with the bow sight window perimeter 72 when the bow sight window 70 substantially overlaps with and is hidden by the peep window 74. FIGS. 10A-B illustrate a forward adjusted position of the bow sight 20 in which the portion of the sight component 34 defining the bow sight window 70 and the entirety of sight pins 71A-C can be seen within the peep window 74. FIGS. 12A-B illustrate a rearward adjusted position of the bow sight 20 in which the sight component 34 is positioned too close to the peep sight 24 so that only a small portion of the sight component 34 is visible (i.e., only portions of the sight pins 71A-C are visible). FIGS. 11A-B illustrate a still further adjusted position of the bow sight 20 in which the bow sight window perimeter 72 is aligned with the peep window perimeter 76. The adjusted position shown in FIGS. 11A-B is typically preferred in order to optimize performance of the bow sight 20 and the bow 10.

FIGS. 10B, 11B, 12B provide a proximal view looking through the peep sight 24 from the vantage point of the bow operator. FIGS. 10A, 11A, 12A show the bow 10 in a drawn position with the bow sight 20 in three different adjusted positions. The three different adjusted positions shown in FIGS. 10-12 represent different adjusted positions of the mounting bracket 40 along the length of the first and second support rails 42, 44. The infinite adjustability of the mounting bracket 40 relative to the first and second support rails 42, 44 provides incremental adjustment of the sight component 34 until alignment between the bow sight window perimeter 72 and peep window perimeter 76 is achieved as shown in FIGS. 11A-B. The adjusted positions of the mounting bracket 40 relative to the first and second support rails 42, 44 may be fixed by operating the fasteners 56 to tighten the mounting bracket 40 about the first and second support rails 42, 44. Loosening the fasteners 56 may again provide adjustability of the mounting bracket 40 relative to the first and second support rails 42, 44. The adjustment may be made whether or not the bow 10 is in a drawn position.

An example method of operating an archery bow includes providing an archery bow having a riser, a bowstring, a peep sight mounted to the bowstring, and a bow sight mounted to the riser as described above with references to FIGS. 1-2. The peep sight has a peep window with a peep window perimeter, and the bow sight has a bow sight window with a bow sight window perimeter. The method includes adjusting the bow sight to move the bow sight window toward and away from the peep window until the bow sight window perimeter is aligned with the peep window perimeter when looking through the peep window. Other aspects of the method may include providing infinite adjustability of the bow sight when moving the bow sight window toward and away from the peep window. The method may also include providing the adjustment while the bow is drawn. The adjustability of the bow sight may include sliding a mounting bracket of the bow sight along at least one support rail of the bow sight as discussed above.

Another example method according to the present disclosure relates to operating a bow sight assembly. The bow sight is mounted to a riser of an archery bow, and a peep sight is mounted to a bowstring of the archery bow. The peep sight has a peep window. The method may include providing sliding adjustment of the bow sight relative to the peep sight to align portions of the bow sight within the peep sight when looking through the peep window as described above with reference to FIGS. 10-12. This sliding adjustment may include moving a sight component of the bow sight toward and away from the peep sight. This sliding adjustment may include infinite sliding adjustment of the bow sight relative to the peep sight. The method may also include aligning portions of the bow sight within the peep window such as aligning a bow sight window perimeter with a peep window perimeter.

A further example method according to the present disclosure relates to a method of operating a bow sight that is mounted to a riser of an archery bow. The bow sight includes a mounting assembly and a sight component supported by the mounting assembly. The mounting assembly includes a mounting bracket and at least one support rail. The mounting bracket is connected to the riser. The method includes operating the mounting bracket to permit sliding movement of the at least one support rail relative to the mounting bracket to move the sight component toward and away from the riser. The method also includes operating the mounting bracket to fix a position of the at least one support rail relative to the mounting bracket to fix a position of the sight component relative to the riser. The relative sliding movement between the at least one support rail and the mounting bracket may provide infinite adjustability of the position of the sight component relative to the riser.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" may connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An archery bow comprising:

a riser;

a pair of limbs extending from the riser;

a bowstring extending between the pair of limbs;

a peep sight mounted to the bowstring and having a peep window with a peep window perimeter;

a bow sight adjustably mounted to the riser with a mounting assembly, the bow sight having a bow sight window with a bow sight window perimeter, the mounting assembly being operable to move the bow sight window toward and away from the peep sight, the peep window perimeter being aligned with the bow sight window perimeter when looking through the peep window in a drawn bowstring position.

2. The archery bow of claim 1 wherein the mounting assembly is infinitely adjustable within an adjustment range.

3. The archery bow of claim 1 wherein the mounting assembly includes a mounting bracket and at least one support rail, the mounting assembly being mounted to the riser and movable along the at least one support rail to move the bow sight window toward and away from the peep sight.

4. The archery bow of claim 3 wherein the at least one support rail includes first and second support rails.

5. The archery bow of claim 1 wherein the peep window perimeter and bow sight window perimeter are each circular shaped.

6. A method of operating an archery bow, comprising:

providing an archery bow comprising a riser, a bowstring, a peep sight mounted to the bowstring, and a bow sight mounted to the riser, the peep sight having a peep window with a peep window perimeter, and the bow sight having a bow sight window with a bow sight window perimeter;

adjusting the bow sight to move the bow sight window toward and away from the peep window until the bow sight window perimeter is aligned with the peep window perimeter when looking through the peep window.

7. The method of claim 6 further comprising providing infinite adjustability of the bow sight when moving the bow sight window toward and away from the peep window.

8. The method of claim 6 further comprising drawing the archery bow and maintaining the archery bow drawn while adjusting the bow sight.

9. The method of claim 6 wherein the bow sight includes a mounting assembly and a sight component, the sight component defining the bow sight window, the mounting assembly including a mounting bracket configured to connect the bow sight to the riser, and first and second support rails coupled to the mounting bracket and the sight component, and adjusting the bow sight includes moving the mounting bracket along the first and second support rails.

10. The method of claim 6 wherein adjusting the bow sight includes sliding a mounting bracket of the bow sight along at least one support rail of the bow sight, the bow sight window being coupled to the at least one support rail.

11. A method of operating a bow sight assembly, comprising:

providing a bow sight mounted to a riser of an archery bow, the bow sight having a bow sight window, the bow sight window including a bow sight window perimeter, and a peep sight mounted to a bowstring of the archery bow, the peep sight having a peep window, the peep window including a peep window perimeter;

providing sliding adjustment of the bow sight relative to the peep sight to at least align portions of the bow sight window perimeter of the bow sight with the peep window perimeter when looking through the peep window.

12. The method of claim 11, wherein the sliding adjustment moves a sight component of the bow sight toward and away from the peep sight.

13. The method of claim 11, wherein the sliding adjustment includes infinite sliding adjustment of the bow sight relative to the peep sight.

* * * * *